US007954522B2

(12) United States Patent
Yang

(10) Patent No.: US 7,954,522 B2
(45) Date of Patent: Jun. 7, 2011

(54) GUIDING DEVICE FOR A TENONER

(76) Inventor: Jack Yang, Fongyuan (TW)

( * ) Notice: Subject to any disclaimer, the term of this patent is extended or adjusted under 35 U.S.C. 154(b) by 150 days.

(21) Appl. No.: 12/497,754

(22) Filed: Jul. 6, 2009

(65) Prior Publication Data

US 2011/0000580 A1 Jan. 6, 2011

(51) Int. Cl.
*B27F 1/00* (2006.01)

(52) U.S. Cl. ..... 144/85; 144/144.51; 144/145.1; 144/144.1; 144/82

(58) Field of Classification Search ..... 144/82, 144/69–71, 74, 75, 78–81, 85, 87, 88, 144.1, 144/144.51, 145.1
See application file for complete search history.

(56) References Cited

U.S. PATENT DOCUMENTS

| | | | | |
|---|---|---|---|---|
| 4,428,408 | A | 1/1984 | Grisley | 144/144.5 |
| 6,032,706 | A * | 3/2000 | Lear | 144/144.51 |
| 6,116,303 | A * | 9/2000 | Hampton | 144/144.51 |
| 6,929,042 | B2 * | 8/2005 | Chang | 144/71 |
| D579,469 | S * | 10/2008 | Yang | D15/122 |
| 7,455,089 | B2 * | 11/2008 | McDaniel et al. | 144/144.1 |
| 7,507,060 | B2 * | 3/2009 | Grisley | 409/137 |
| 7,717,145 | B2 * | 5/2010 | McDaniel | 144/144.1 |
| 7,819,146 | B2 * | 10/2010 | McDaniel | 144/144.51 |
| 2006/0249228 | A1 * | 11/2006 | Hout et al. | 144/144.1 |

* cited by examiner

*Primary Examiner* — Shelley Self
(74) *Attorney, Agent, or Firm* — Alan Kamrath; Kamrath & Associates PA

(57) ABSTRACT

A guiding device for a tenoner includes a mounting member for mounting the guiding device on the tenoner and for releasably engaging with a plurality of guide members. The mounting member includes a recess inset on a lateral side thereof. Each guide member includes an engaging section and a guiding section, and the engaging section is moveably engaged in the recess and is adapted to be fixed at various positions.

17 Claims, 13 Drawing Sheets

GUIDING DEVICE FOR A TENONER

BACKGROUND OF THE INVENTION

1. Field of the Invention

The present invention relates to a guiding device for a tenoner and, in particular to a guiding device which is adjustable for making various sizes of tenons and/or mortises 2. Description of the Related Art U.S. Pat. No. 4,428,408 shows a jig including a plurality of guide fingers, and a securing device adjustably securing each guide finger to a support. The guide fingers which are disposed adjacently have a spacing which is selectively variable. In order to span the spaces between the guide fingers, the jig is provided with a slide plate having parallel side edges and is inset into recesses formed in the fingers. Therefore, the plate combines with the uppermost edges of the fingers to provide the required even surface for slidably supporting the cutting tool. While the slide plate enables the guide fingers move thereon, the design of the slide plate is intricate and includes many complexly arranged elements.

The present invention is, therefore, intended to obviate or at least alleviate the problems encountered in the prior art.

SUMMARY OF THE INVENTION

According to the present invention, a guiding device for a tenoner includes a mounting member for mounting the guiding device on the tenoner and for releasably engaging with a plurality of guide members. The mounting member includes a recess inset on a lateral side thereof. Each guide member includes an engaging section and a guiding section, and the engaging section is moveably engaged in the recess and is adapted to be fixed at various positions. The guiding section includes a first engaging side and a second engaging side opposite to the first engaging side. Two of the plurality of guide members are engagable with each other such that the respective first engaging sides are engaged with each other, and the two guiding sections cooperated to define a first spacing that determines a minimum size of the tenon and/or the mortise. Furthermore, two of the plurality of guide members are engagable with each other such that the respective second engaging sides are engaged with each other, and one pair of the two guide members is spaced from another pair of the two guide members at various distances for determining other sizes of the tenon and/or the mortise.

It is an object of the present invention that the mounting member is of a simple configuration.

It is another object of the present invention that each of the plurality of guide members is moveable in the recess and is adapted to be fixed various positions.

DETAILED DESCRIPTION OF THE PREFERRED EMBODIMENT

Figure 1:
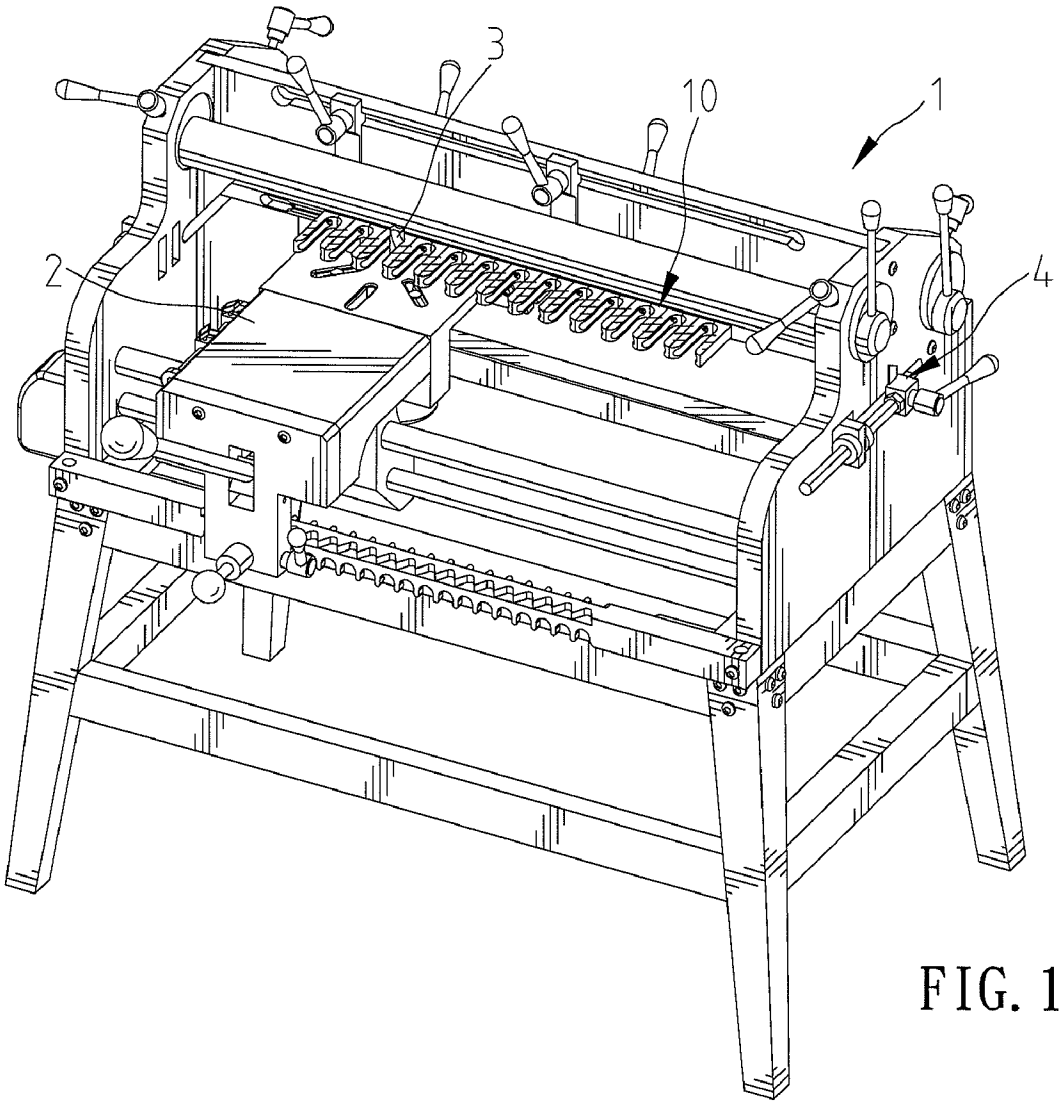
FIG. 1 is a perspective view of a tenoner including a guiding device in accordance with the present invention.
Figure 2:
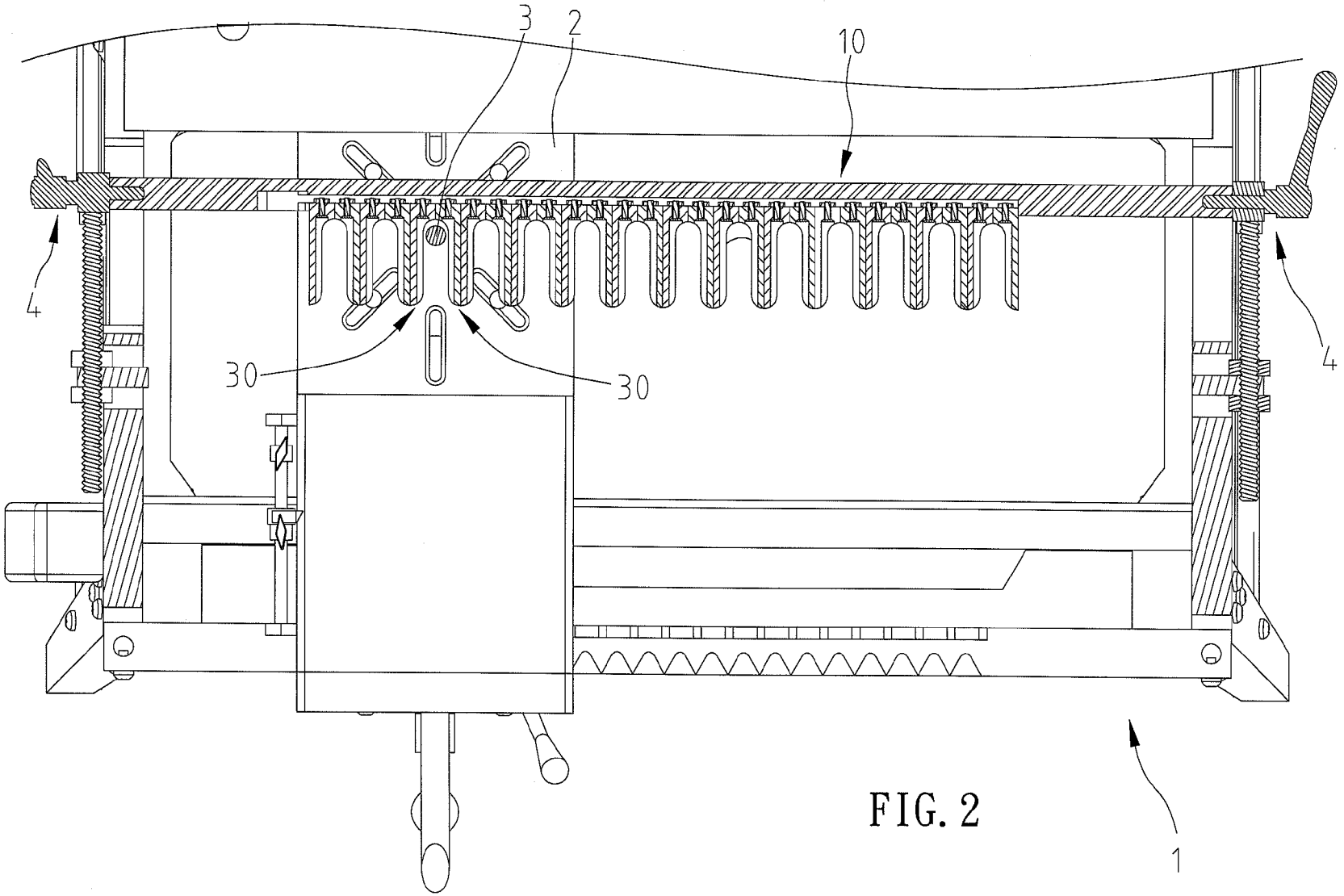
FIG. 2 is a partial, cross-sectional view of the tenoner and the guiding device shown in FIG. 1.
Figure 3:
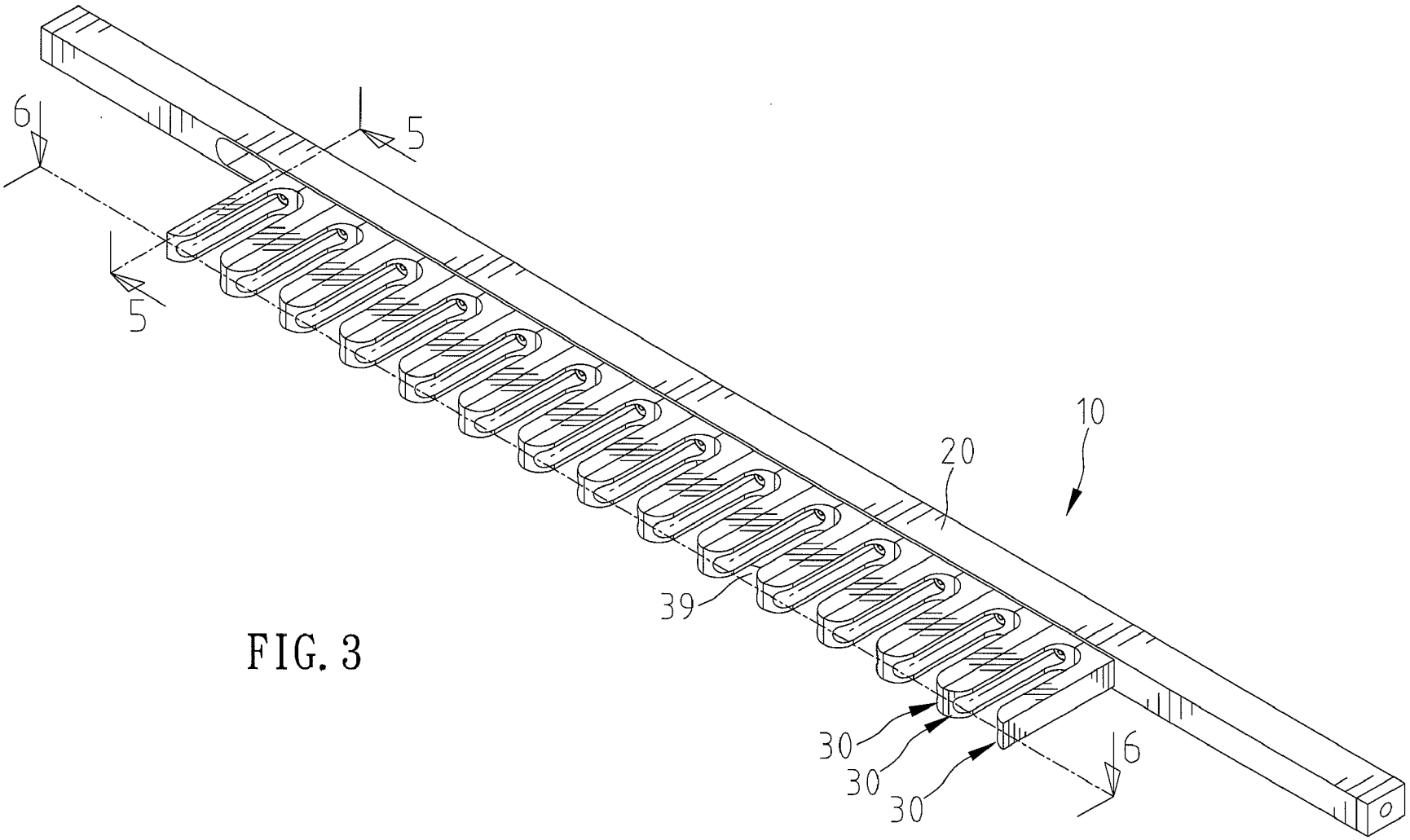
FIG. 3 is a perspective of the guiding device shown in FIG. 1.
Figure 4:
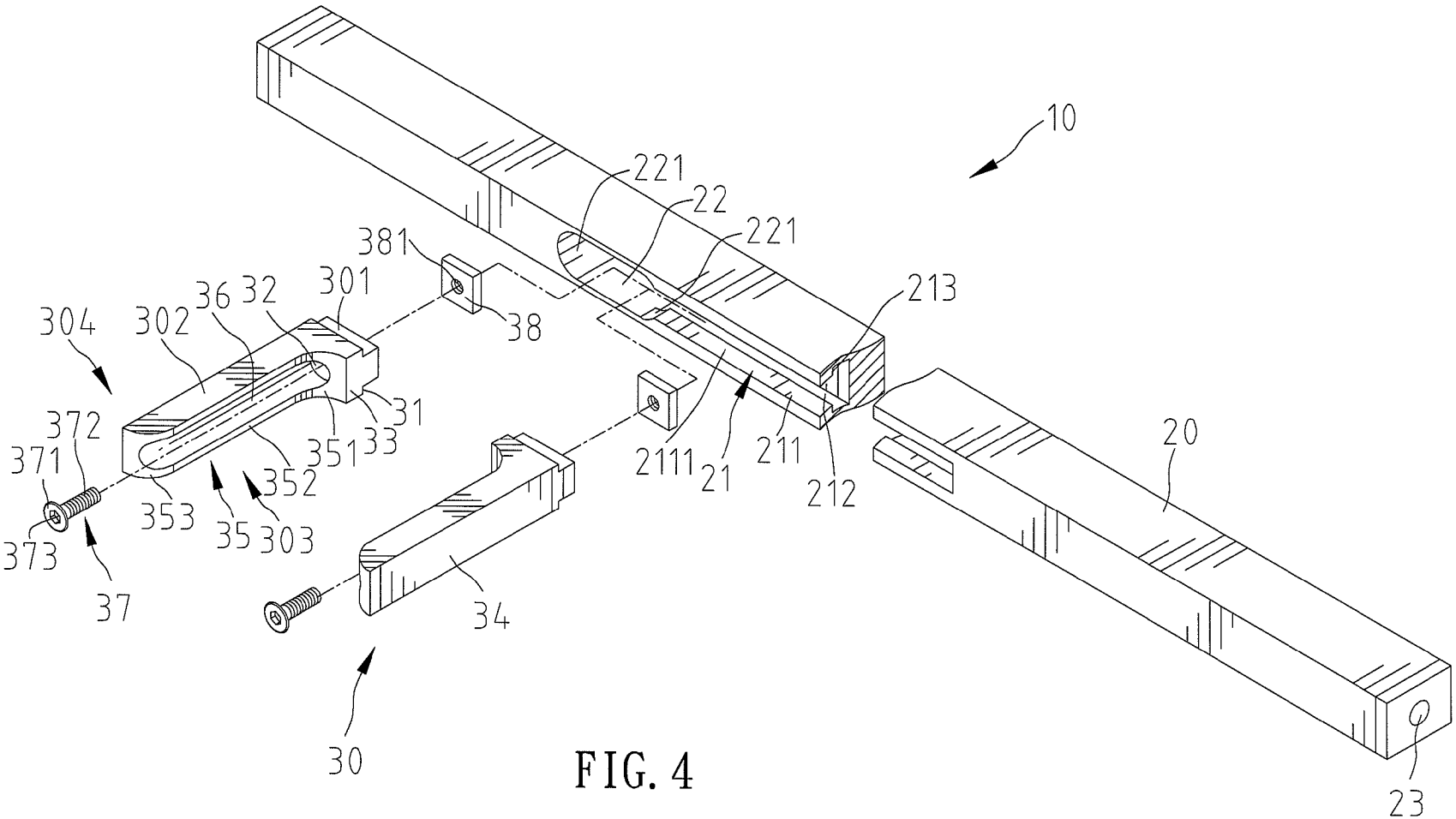
FIG. 4 is an exploded perspective view of the guiding device shown FIG. 3.
Figure 5:
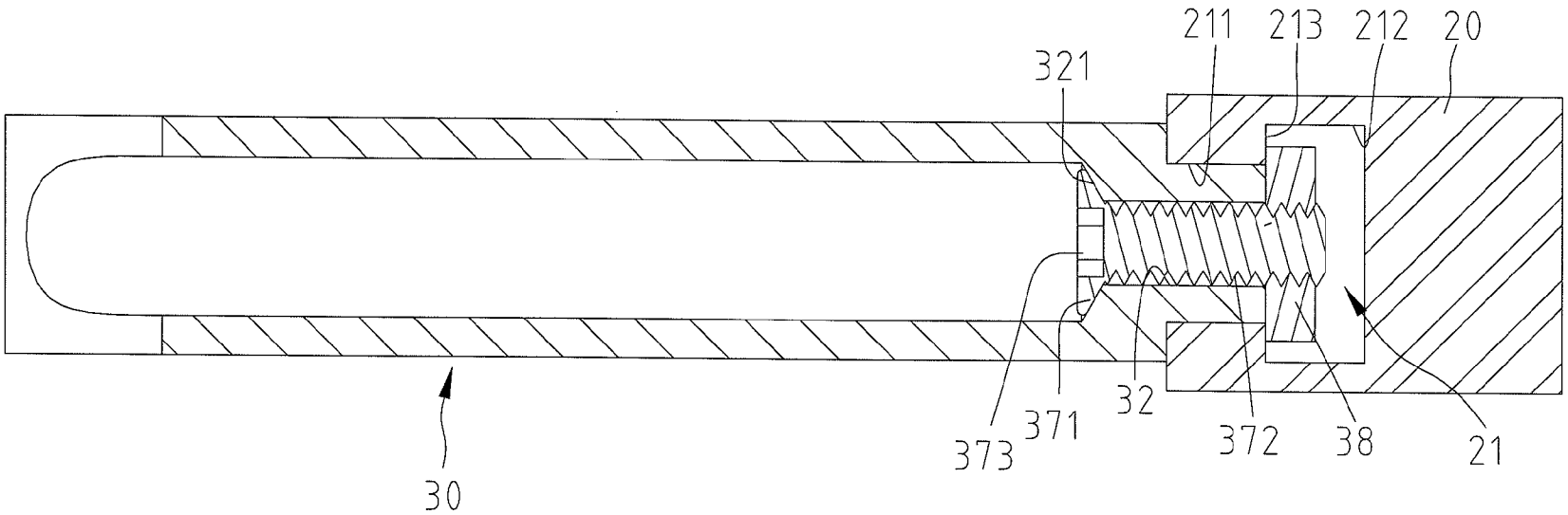
FIG. 5 is a cross-sectional view taken along line 5-5 of FIG. 3.
Figure 6:
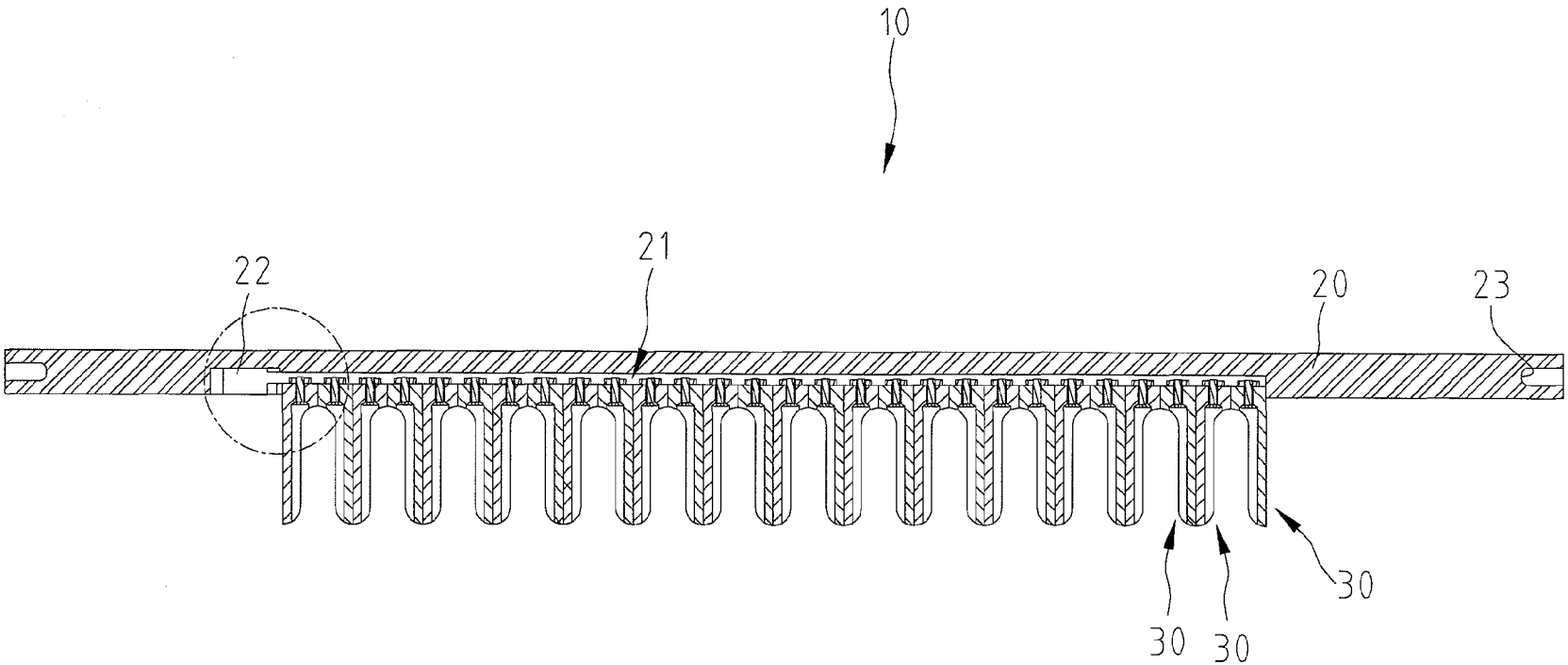
FIG. 6 is a cross-sectional view taken along line 6-6 of FIG. 3.
Figure 7:
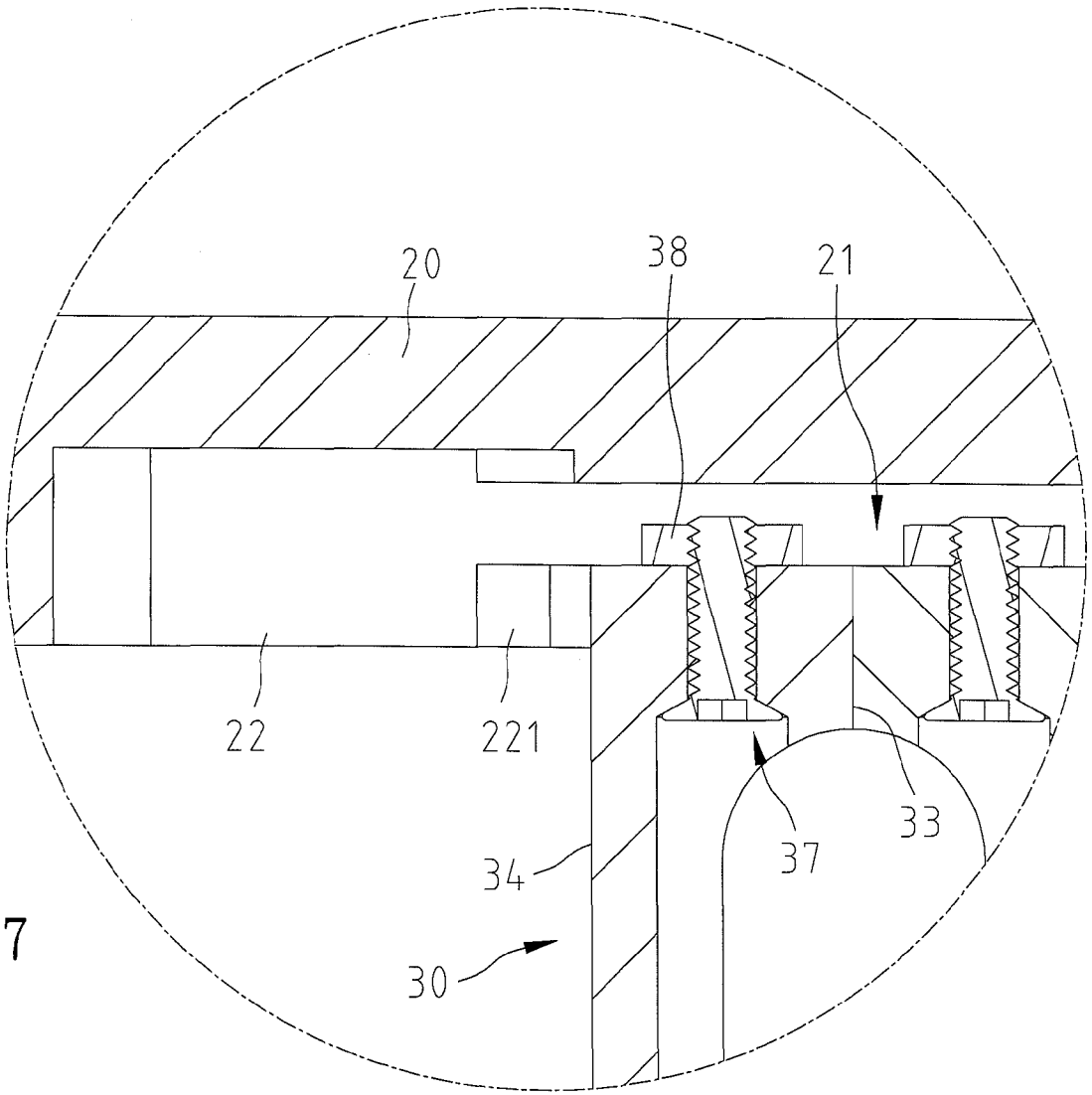
FIG. 7 is a partial, enlarged view of FIG. 6.
Figure 8:
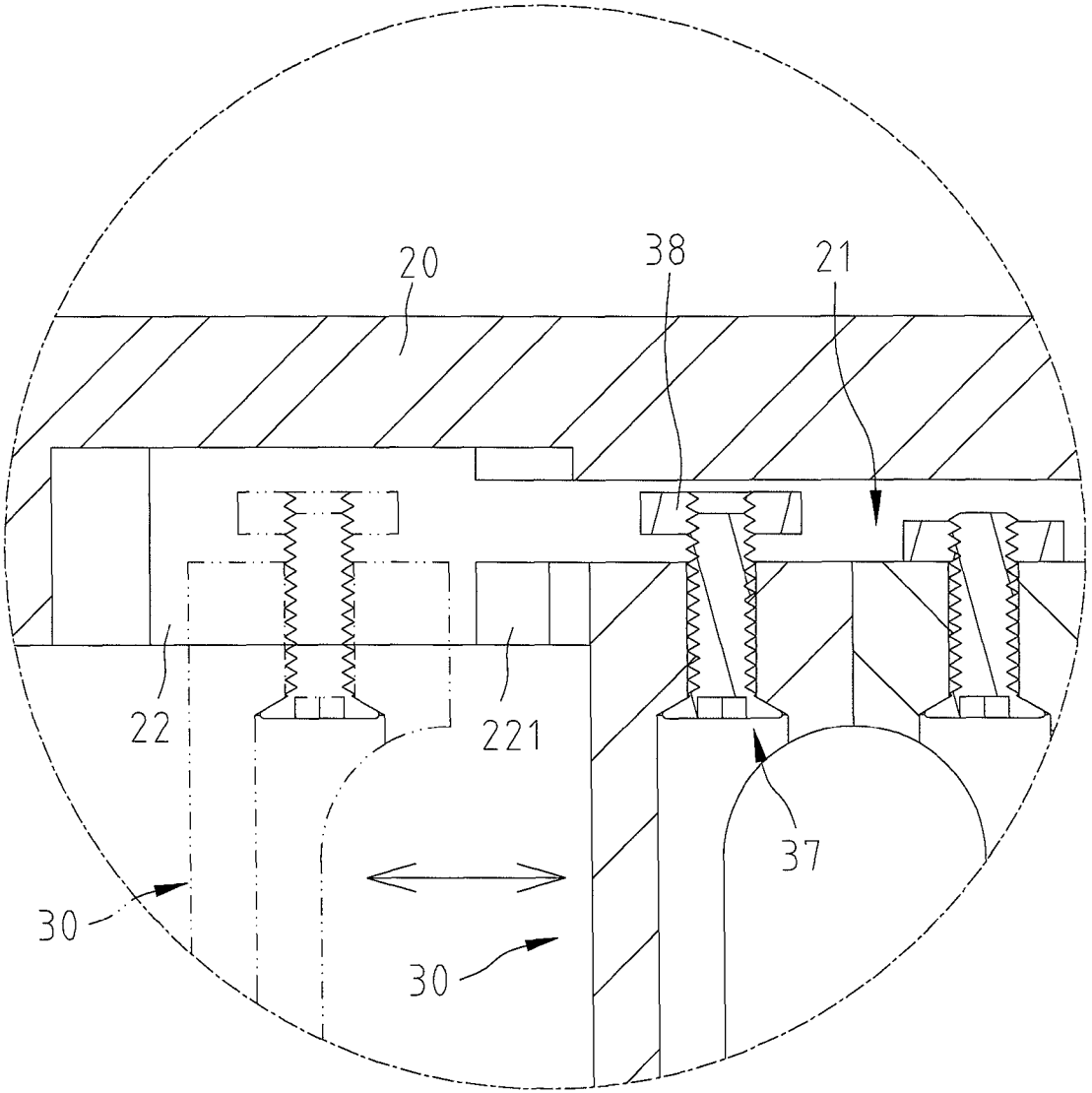
FIG. 8 is an extended view of FIG. 7 and shows a guide member in a released position such that the guide member is adapted to be moved longitudinally in the guiding device.
Figure 9:
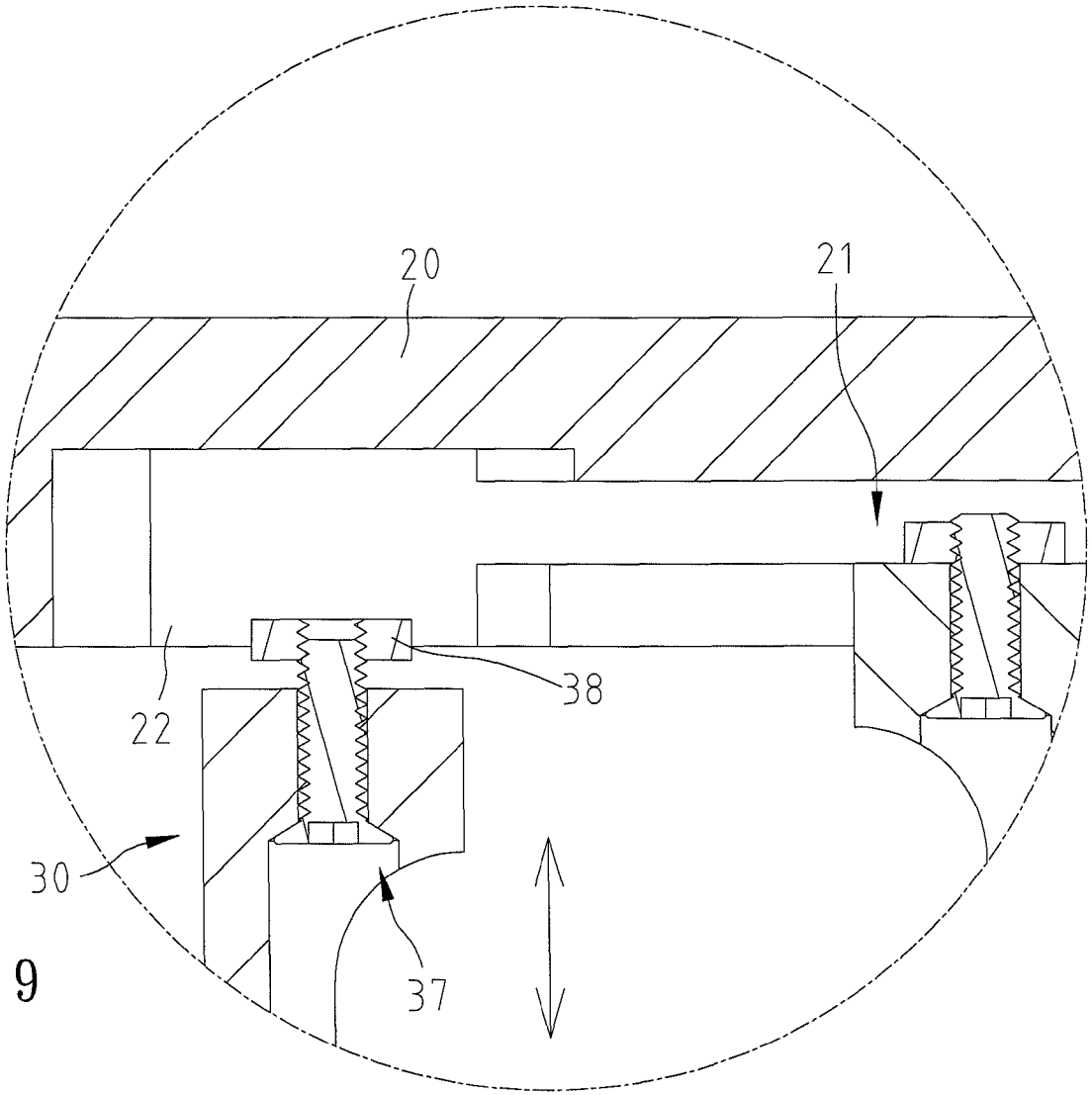
FIG. 9 is an extended view of FIG. 8 and shows the guide member removed from the guiding device.
Figure 10:
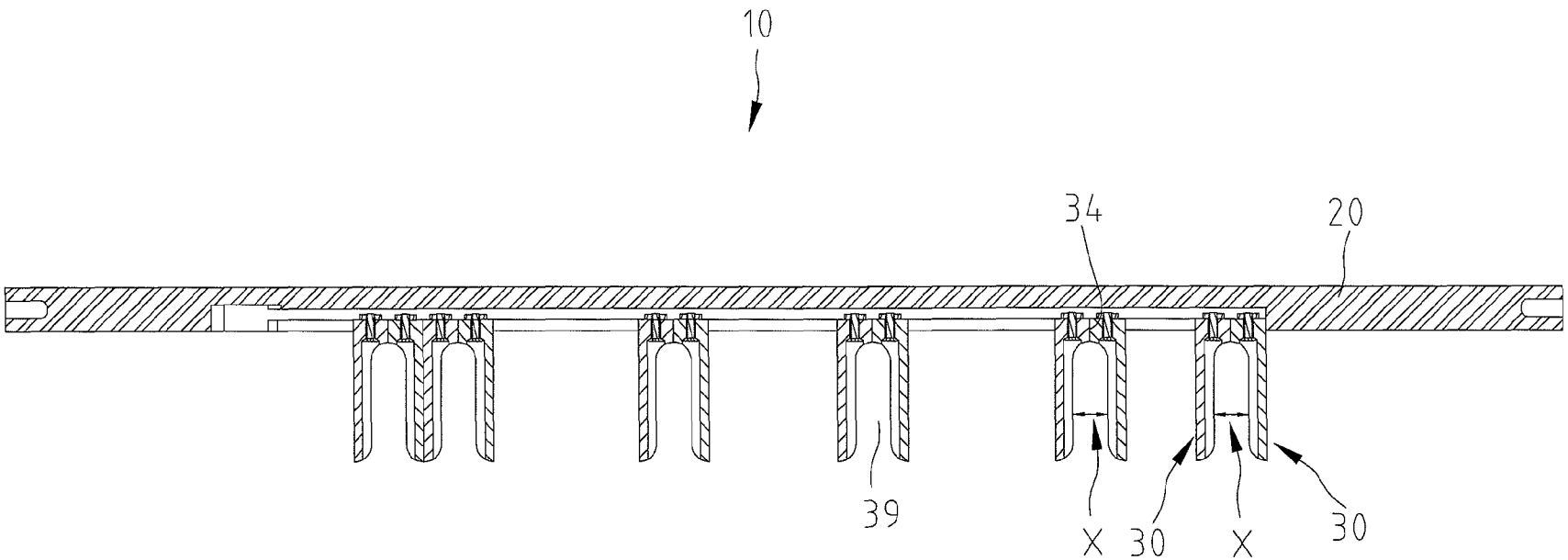
FIG. 10 shows two adjacent guide members having first engaging sides engaged with each other and a spacing defined between the guide members determines a minimum size of a tenon and/or a mortise.
Figure 11:
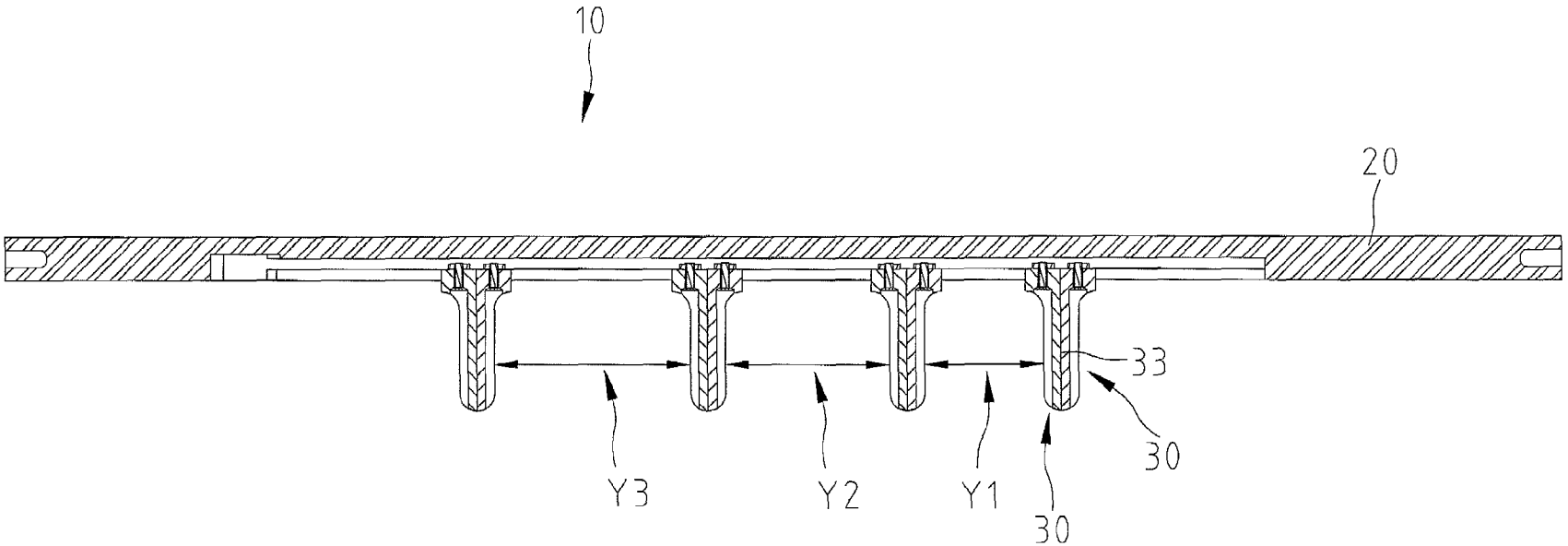
FIG. 11 shows two adjacent guide members having second engaging sides engaged with each other and one pair of the guide members spaced from another pair of guide members at a distance, with the distance being selectively variable, and with the distance determining size of a tenon and/or a mortise.

FIGS. 1 and 2 show a tenoner 1 including a guiding device 10 in accordance with a first embodiment of the present invention. The guiding device 10 is mounted parallel to the tenoner 1 and is adapted to be adjustably moved by an adjusting device 4. Preferably, the guiding device 10 is moved transversely to a longitudinal axis of the tenoner 1. The tenoner 1 also includes a transporting device 2 which is moved horizontally and in the longitudinal axis of the tenoner 1. Further, a cutting bit 3 is mounted on the transporting device 2 and is moveable with the transporting device 2, and is adapted to be selectively moved into a spacing between two guide members 30 of the guiding device 10 for machining a tenoner and/or a mortise from a workpiece.

Referring to FIGS. 2 through 11, the guiding device 10 further includes a mounting member 20 for mounting the guiding device 10 on the tenoner 1 and for releasably engaging with a plurality of guide members 30. The mounting member 20 has two ends connected with the tenoner 1, and each end has an engaging hole 23 for engaging with the adjusting device 4. The mounting member 20 also includes a lateral side having a first recess 21 and a second recess 22 inset thereon. The first and second recesses 21 and 22 extend in a longitudinal direction of the mounting member 20. Additionally, the first recess 21 is connected and in communication with the second recess 22.

The first recess 21 is configured of a first section 211 and a second section 212, the first and second sections 211 and 212 extend transversely to the axial direction of the mounting member 20, and the first section 211 has a longitudinal length, i.e. in the longitudinal direction of the mounting member 20, equal to that of the second section 212. Additionally, the first section 211 has a cross sectional area smaller than that of the second section 212. Thus, a stopping edge 213 is formed and extends between a peripheral edge of the first section 211 and a peripheral edge of the second section 212. The first section 211 also defines an opening 2111 on the lateral side, and the opening 2111 has a size determined by the cross sectional area thereof.

The second recess 22 has a cross sectional area larger than the cross sectional area of the first section 211 of the first recess 21 and may equal to the cross sectional area of the second section 212 of the first recess 21. The second recess 22 defines a second opening 221 on the lateral side larger and the second opening 221 is larger than the first opening 2111. Further, the second recess 22 may include a chamfered edge 221 extending between the second recess and the first section 211 of the first recess 21 for reducing stress-concentration and for facilitating each guide member 30 to move from the second recess 22 to the first recess 21, as described hereafter.

Each guide member 30 includes an engaging section 301 and a guiding section 302 extending from the engaging section 301. The engaging section 301 is connected with a retainer 38 by a fastener 37 which is inserted through a hole 32 extending from the guiding section 302 and through the engaging section 301 and is engaged with the retainer 38. The fastener 37 is engagable with the retainer 38 between a first position such that the retainer 38 is spaced from the engaging section 301 and a second position such that the retainer 38 is in contact with the engaging section 301, and the fastener 37 is engaged in the first position of the retainer 38 for installation of the guide member 30 on the mounting member 20. Preferably, the fastener 37 includes an outer threaded section 372, and the retainer 38 includes an engaging aperture 381 extending therein and including an inner threaded section for engaging with the outer threaded section 372 of the fastener 37. Furthermore, the engaging section 301 includes a cross sectional area marginally smaller than that of the first section 211 of the first recess 21, and the guiding section 302 includes a cross sectional area larger than that of the first section 211 of the first recess 21. Thus, a stopping wall 31 is formed and extends between a peripheral edge of the engaging section 301 and a peripheral edge of the guiding section 302. Also, the retainer 38 includes a cross sectional area larger than that of the first section 211 of the first recess 21 and smaller than that of the second section 211 of the first recess 21 and smaller than that of the second recess 22. Thus, the engaging section 301 and the retainer 38 are adapted to be inserted in the second recess 22, and since the fastener 37 is engaged in the first position of the retainer 38, the engaging section 301 and the retainer 38 are adapted to be moved in the first recess 21. The guiding member 30 is adapted to be secured with the mounting member 20 by engaging the fastener 37 in the second position of the retainer 38. Thus, the stopping wall 31 is abutted against the lateral side of the mounting member 20, the retainer 38 is abutted against the stopping edge 213 and the engaging section 301, and the engaging section 301 is retained in the first section 211 of the first recess 21. Likewise, the guiding member 30 is adapted to be removed from the mounting member by engaging the fastener 37 in the first position of the retainer 38. Thus, the retainer 38 is detached from the stopping edge 213 and the engaging section 301 in order to remove the guide member 30 from the mounting member 20. It is understood that the chamfered edge 221 guides and facilitates the engaging section 301 and the retainer 38 from the first recess 21 to the second recess 22, or otherwise.

The guiding section 302 of each guide member 30 further includes a first lateral edge 303 and a second lateral edge 304 opposite to the first lateral edge 303. The first lateral edge 303 is defined by a first engaging side 33 and a guiding side 35 which is configured of a preferably arcuate first guiding edge 351 extending from the first engaging side 33, a preferably straight second guiding edge 352 extending from the first guiding edge 351, and a preferably arcuate third guiding edge 353 extending from the second guiding edge 352. The second lateral edge 304 is defined by a preferably straight second engaging side 34. Additionally, the third guiding edge 353 extends between and interconnects the second guiding edge 352 and the second engaging side 34. Further, the guiding edge 35 may include a channel 36 extending axially through the first, second and third guiding sides 351, 352 and 353 and connected to and in communication with the hole 32. Thus, the fastener 37 is adapted to be inserted in the hole 32 via the channel 36. Moreover, the channel 36 has a cross sectional area larger than that of the hole 32. Thus, a flange 321 is formed and extends between a peripheral edge of the channel 36 and a peripheral edge of the hole 32. Likewise, the fastener 37 includes a head 371 having a cross sectional area larger than that of the hole 32. Thus, the head 371 is adapted to be retained on the flange 321. Additionally, the head 371 has a cavity 373 which enables a tool to be engaged with, and the tool is adapted to move the fastener 37 between the first position in the retainer 38 and the second position in the retainer 38.

Two adjacent guide members 30 are adapted to have their first engaging sides 33 engaged with each other and the guiding edges 35 are cooperated to define a first spacing 39. The first spacing 39 determines a minimum size of a tenon and/or a mortise and is substantially U-shaped. Additionally, the first spacing 39 includes a distance "X" between the two second guiding sides 352.

Two adjacent guide members 30 are also adapted to have their second engaging sides 34 engaged with each other and a pair of guide members 30 is adapted to be spaced from another pair of guide members 30 at various distances i.e. Y1, Y2 and Y3.

Figure 12:
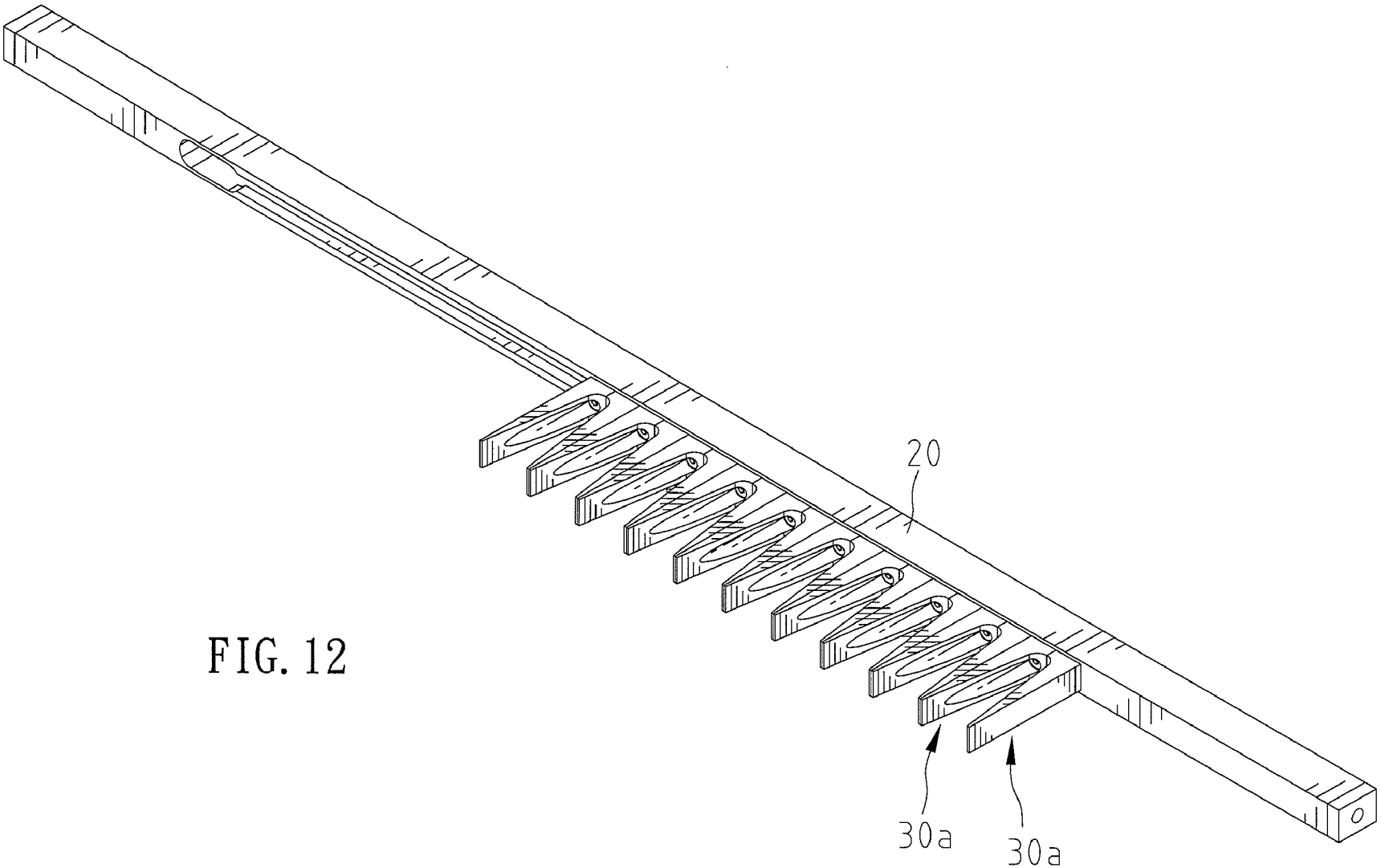
FIG. 12 is a perspective view of a guiding device in accordance with a second embodiment of the present invention.
Figure 13:
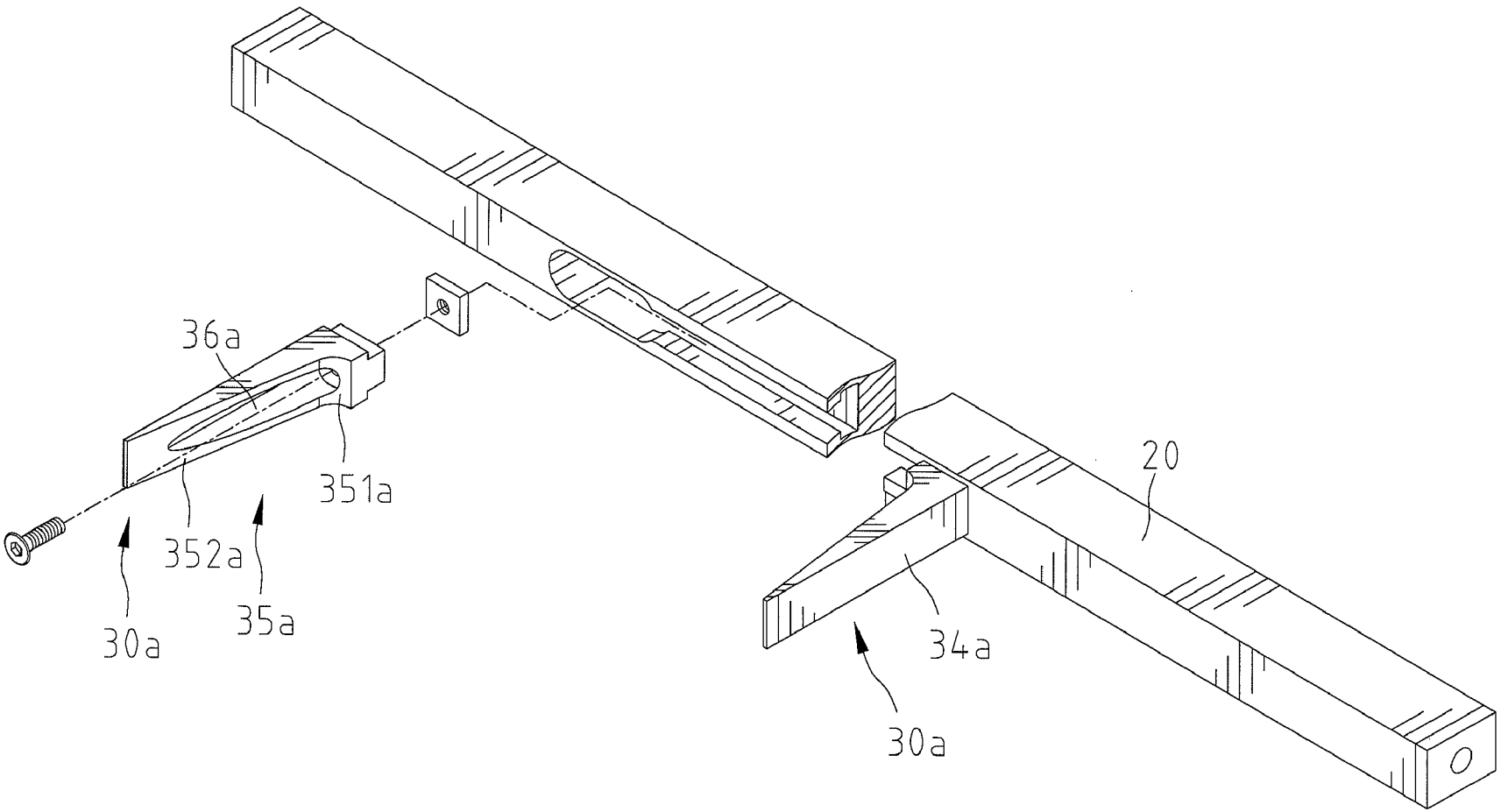
FIG. 13 is an exploded perspective view of the guiding device shown in FIG. 12.

FIGS. 12 and 13 show a guiding device in accordance with a second embodiment of the present invention, wherein like numerals are employed to denote like components of the first embodiment, however bearing the suffix "a". The second embodiment is similar to the first embodiment except that it includes a plurality of guiding members 30*a*, and each guiding member 30*a* includes a guiding side 35*a* which is configured of a preferably arcuate first guiding edge 351*a*, and a preferably straight second guiding edge 352*a* extending from the first guiding edge 351*a*. The second guiding edge 352*a* extends between and interconnects the first guiding edge 352*a* and a second engaging side 34*a*.

While the specific embodiments have been illustrated and described, numerous modifications come to mind without significantly departing from the spirit of invention and the scope of invention is only limited by the scope of accompanying claims.

What is claimed is:

1. A guiding device for a tenoner which makes tenons and/or mortises comprising:

a mounting member mounted on the tenoner and including a recess inset on a lateral side thereof; and a plurality of guide members releasably engaged with the mounting member and each including an engaging section and a guiding section extending from the engaging section, with the engaging section moveably engaged in the recess and adapted to be fixed at various positions, and with the guiding section including a first engaging side and a second engaging side opposite to the first engaging side; and wherein two of the plurality of guide members are engagable with each other such that the respective first engaging sides are engaged with each other, and the two guiding sections cooperated to define a first spacing that determines a minimum size of the tenon and/or the mortise; and wherein two of the plurality of guide members are engagable with each other such that the respective second engaging sides are engaged with each other, and one pair of the two guide members is spaced from another pair of the two guide members at various distances for determining other sizes of the tenon and/or the mortise.

2. The guiding device as claimed in claim 1 wherein the recess includes a first recess configured of a first section and a second section, with the first section having a first cross sectional area and the second section having a second cross sectional area larger than the first cross sectional area, with the first section defining a first opening on the lateral side, and the opening having a size determined by the first cross sectional area, with the first recess including a stopping edge extending between a peripheral edge of the first section and a peripheral edge of the second section.

3. The guiding device as claimed in claim 2 wherein the first section extends in a longitudinal direction of the mounting member and defines a first length, and wherein the second section extends in the longitudinal direction of the mounting member and defines a second length, with the first length equaling to the second length.

4. The guiding device as claimed in claim 2 wherein the recess includes a second recess extending in a longitudinal direction of the mounting member and connected and in communication with the second recess, with the second recess including a cross sectional area larger than the first cross sectional area and defining a second opening on the lateral side larger than the first opening.

5. The guiding device as claimed in claim 1 wherein each of the plurality of the guide members includes a retainer and a fastener connecting the retainer with the engaging section, and with the fastener engagable with the retainer between a first position such that the retainer is spaced from the engaging section and a second position such that the retainer is in contact with the engaging section.

6. The guiding device as claimed in claim 5 wherein the engaging section includes a hole extending therethrough, and wherein the fastener is inserted through the hole and connected with the retainer.

7. The guiding device as claimed in claim 6 wherein the fastener includes an outer threaded section, and wherein the retainer includes an engaging aperture extending therein and including an inner threaded section for engaging with the outer threaded section of the fastener.

8. The guiding device as claimed in claim 2 wherein the engaging section includes a cross sectional area marginally smaller than the first cross sectional area, and wherein the guiding section includes a cross sectional area larger than the first cross sectional area, and wherein the guide member defines a stopping wall extending between a peripheral edge of the engaging section and a peripheral edge of the guiding section.

9. The guiding device as claimed in claim 8 wherein each of the plurality of the guide members includes a retainer and a fastener connecting the retainer with the engaging section, and with the fastener engagable with the retainer between a first position such that the retainer is spaced from the engaging section and a second position such that the retainer is in contact with the engaging section.

10. The guiding device as claimed in claim 9 wherein the retainer includes a cross sectional area larger than that of the first cross sectional area and smaller than the second cross sectional area.

11. The guiding device as claimed in claim 9 wherein the fastener is engaged in the second position of the retainer, the stopping wall is abutted against the lateral side of the mounting member, the retainer is abutted against the stopping edge and the engaging section, and the engaging section is retained in the first section of the first recess when each of the plurality of guiding members is secured with the mounting member.

12. The guiding device as claimed in claim 9 wherein the fastener is engaged in the first position of the retainer, the retainer is detached from the stopping edge and the engaging section when each of the plurality of guiding members is adapted to be removed from the mounting member.

13. The guiding device as claimed in claim 1 wherein the guiding section includes a first lateral edge and a second lateral edge opposite to the first lateral edge, with the first lateral edge defined by the first engaging side and a guiding side, with the guiding side configured of an arcuate first guiding edge extending from the first engaging side, a straight second guiding edge extending from the first guiding edge, and an arcuate third guiding edge extending from the second guiding edge, with the second lateral edge defined by the second engaging side, with the second engaging side being straight, and with the third guiding edge extending between and interconnects the second guiding edge and the second engaging side.

14. The guiding device as claimed in claim 6 wherein the guiding section includes a first lateral edge and a second lateral edge opposite to the first lateral edge, with the first lateral edge defined by the first engaging side and a guiding side, with the guiding side configured of an arcuate first guiding edge extending from the first engaging side, a straight second guiding edge extending from the first guiding edge, and an arcuate third guiding edge extending from the second guiding edge, with the second lateral edge defined by the second engaging side, with the second engaging side being straight, and with the third guiding edge extending between and interconnecting the second guiding edge and the second engaging side.

15. The guiding device as claimed in claim 14 further including a channel extending axially through the first, second and third guiding sides and connected to and in communication with the hole, and wherein the channel has a cross sectional area larger than a cross sectional area of the hole, and wherein the fastener includes a head having a cross sectional area larger than that of the hole.

16. The guiding device as claimed in claim 1 wherein the guiding section includes a first lateral edge and a second lateral edge opposite to the first lateral edge, with the first lateral edge defined by the first engaging side and a guiding side configured of an arcuate first guiding edge, and a straight second guiding edge extending from the first guiding edge, with the second lateral edge defined by the second engaging side, with the second engaging side being straight, and with the second guiding edge extending between and interconnecting the first guiding edge and the second engaging side.

17. The guiding device as claimed in claim 1 wherein the first spacing is substantially U-shaped.

* * * * *